US011097883B2

(12) United States Patent
Collins et al.

(10) Patent No.: US 11,097,883 B2
(45) Date of Patent: Aug. 24, 2021

(54) CONTAINER FOR CONSUMER GOODS WITH RECLOSABLE FLAP

(71) Applicant: JT International S.A., Geneva (CH)

(72) Inventors: Tim Collins, West Horsley (GB); Gabriela Greco, Chêne-Bourg (CH)

(73) Assignee: JT International S.A.

( * ) Notice: Subject to any disclaimer, the term of this patent is extended or adjusted under 35 U.S.C. 154(b) by 0 days.

(21) Appl. No.: 16/495,265

(22) PCT Filed: Mar. 20, 2018

(86) PCT No.: PCT/EP2018/057017
§ 371 (c)(1),
(2) Date: Sep. 18, 2019

(87) PCT Pub. No.: WO2018/177812
PCT Pub. Date: Oct. 4, 2018

(65) Prior Publication Data

US 2020/0031568 A1 Jan. 30, 2020

(30) Foreign Application Priority Data

Mar. 27, 2017 (EP) ..... 17163185

(51) Int. Cl.
*B65D 85/10* (2006.01)
*B65D 75/58* (2006.01)
*A24F 15/00* (2020.01)

(52) U.S. Cl.
CPC ..... *B65D 75/5838* (2013.01); *A24F 15/00* (2013.01); *B65D 85/1027* (2013.01); *B65D 85/10484* (2020.05); *B65D 85/10568* (2020.05)

(58) Field of Classification Search
CPC ..... B65D 85/1045; B65D 85/10; B65D 85/1027; B65D 75/5838; B65D 85/10568;
(Continued)

(56) References Cited

U.S. PATENT DOCUMENTS 8,091,703 B2 * 1/2012 Marchetti ..... B65D 85/1045 206/268
2010/0230303 A1 * 9/2010 Buse ..... B65D 75/5838 206/268
(Continued)

FOREIGN PATENT DOCUMENTS

DE 102015016456 A1 * 12/2015 ..... B65D 85/10
EP 2281759 A1 2/2011
(Continued)

OTHER PUBLICATIONS

English translation of DE102015016456A1 (Year: 2015).*
(Continued)

*Primary Examiner* — Steven A. Reynolds
(74) *Attorney, Agent, or Firm* — Lerner, David, Littenberg, Krumholz & Mentlik, LLP

(57) ABSTRACT

A container for consumer goods, such as smoking articles, includes an outer housing with a hinged lid that houses an inner package of consumer goods. The inner package has an access opening through which consumer goods can be removed and that is covered by a reclosable flap, which is attached to a first lid panel that is relatively movable to a second lid panel throughout rotation of the lid between lid open and closed positions. Blanks for forming the outer housing and a method of forming the container are also provided.

16 Claims, 9 Drawing Sheets

(58) Field of Classification Search
CPC ..... B65D 85/10454; B65D 85/10484; A24F 15/00; A24F 15/02; A24F 15/12
USPC ..... 206/268, 273, 250, 264
See application file for complete search history.

(56) References Cited

U.S. PATENT DOCUMENTS

| | | | | |
|---|---|---|---|---|
| 2015/0021219 | A1* | 1/2015 | Seyfferth De Oliveira | B65D 85/1045 206/268 |
| 2018/0346235 | A1* | 12/2018 | Buse | B65D 85/1045 |

FOREIGN PATENT DOCUMENTS

| | | | |
|---|---|---|---|
| EP | 2433881 | A1 | 3/2012 |
| TW | 201315396 | A | 4/2013 |
| WO | 2008142540 | A1 | 11/2008 |
| WO | 2017002001 | A1 | 1/2017 |
| WO | 2017108164 | A1 | 6/2017 |

OTHER PUBLICATIONS

Extended European Search Report including Written Opinion for Application No. EP17163185.6, dated Sep. 15, 2017, pp. 1-7.
International Search Report including Written Opinion for Application No. PCT/EP2018/057017, dated Apr. 19, 2018, pp. 1-12.

* cited by examiner

CONTAINER FOR CONSUMER GOODS WITH RECLOSABLE FLAP

CROSS-REFERENCE TO RELATED APPLICATIONS

The present application is a national phase entry under 35 U.S.C. § 371 of International Application No. PCT/EP2018/057017, filed Mar. 20, 2018, published in English, which claims priority to European Patent Application No. 17163185.6 filed Mar. 27, 2017, the disclosures of which are incorporated herein by reference.

BACKGROUND OF THE INVENTION

The present invention relates to a container for consumer goods, in particular a container for smoking articles.

Some cigarette containers comprise a rigid outer housing and a sealed inner package within which cigarettes are contained, such as described in WO 2008/142540. Those containers have a resealable extraction opening in the inner sealed package selectively covered by a cover flap. The cover flap is connected to a hinged lid so that opening and closing the lid simultaneously opens and closes the cover flap over the resealable extraction opening. The cover flap is fixed to the inner package using an adhesive which extends about the whole of the extraction opening so that the cover flap can be detached from the inner package and fixed back again. This can allow the cover flap to seal cigarettes within the inner package when the lid is closed.

With those conventional pack structures, it is challenging to select a bonding strength of the adhesive surfaces adequate for a high quality sealing throughout the life of the container and that allows opening the lid, especially when the container is opened for the first time. If too strong, first opening causes damage to the lid, especially at the hinge and side panels, and, if too weak, attachment of the cover flap to the inner package fails and could even rub off after a number of openings. Further, such a selection has to be done for each combination of cover flap and inner package material or texture.

Several solutions to this problem have been proposed based on a reduction of the effective adhesion area. These solutions are still found unsatisfactory for they are complex and still dependent on the adhering surfaces, thus, only partially addressing the problem.

Another problem identified in these containers is that, once some cigarettes are removed from the inner package, repositioning of the cover flap to the inner package is notoriously less precise, even causing reattachment problems. To solve this problem there have been attempts to use either more complex, and therefore costly, materials, especially for the cover flap, or to rigidise the inner package, for example, by using stiff inner frames located under the sealed package and that surround the cigarettes almost entirely. These solutions are still unsatisfactory as they are more costly and increase manufacturing complexity.

BRIEF SUMMARY OF THE INVENTION

Therefore, it is an object of the invention to provide an improved container for consumer goods with a reclosable flap. Another object of the invention is to provide a blank for forming an outer housing of the improved container.

A first aspect of the invention refers to a container for consumer goods, such as smoking articles, having an outer housing with a hinged lid that houses an inner package of consumer goods. The inner package has an access opening through which consumer goods can be removed and that is covered by a reclosable flap. The reclosable flap is attached to a first lid panel that is relatively movable to a second lid panel throughout rotation of the lid between lid open and closed positions. By providing a first lid panel relatively movable to a second lid panel throughout lid movement between the open and closed positions, and attaching the reclosable flap to the first, movable panel, the reliability of closing the access opening with the reclosable flap is enhanced throughout the life of the container.

The reclosable flap and the first lid panel may be arranged to generate a biasing force on the hinged lid. The biasing force may be generated in favour or against lid movement between the open and closed positions, in one or both senses. The biasing force may be generated to initially oppose lid movement and subsequently favour lid movement.

The reclosable flap and the movable panel may be arranged to generate a biasing force towards the open position when the lid is moved from the closed position towards the open position. By arranging the reclosable flap and the movable panel to generate such biasing force during lid opening, lid opening is eased.

The reclosable flap and the movable panel may be arranged to generate a biasing force towards the closed position when the lid is moved from the closed position towards the open position. By arranging the reclosable flap and the movable panel to generate such biasing force during lid opening, inadvertent lid opening is prevented, particularly when the container is held in a bag or pocket.

The reclosable flap and the movable panel may be arranged to generate a biasing force towards the closed position when the lid is moved from the open position towards the closed position. By arranging the reclosable flap and the movable panel to generate a biasing force towards the closed position during lid closing, lid closing is eased.

The reclosable flap and the movable panel may be arranged to generate a biasing force towards the open position when the lid is moved from the open position towards the closed position. By arranging the reclosable flap and the movable panel to generate such biasing force, a user has to apply an additional force to close the lid. As a result, the user is reassured that the lid is firmly closed.

In some embodiments, the first lid panel may be rotatable about the second lid panel about a rotation axis, in which case a biasing force may be generated by a lever effect. The biasing force may assist lid opening and/or lid closing. Alternatively, or in addition, the biasing force may prevent inadvertent lid opening and/or lid closing.

For example, the first lid panel may be hingedly connected (e.g. by a crease line) to the second lid panel. In a particularly preferred example, an edge of the rotatable panel, which may be opposite the rotation axis of the first lid panel, is in pivoting contact with the inner package throughout a part of the movement of the lid between the open and closed positions. The pivoting contact occurs between the closed position of the lid and an intermediate, stable position, after which the pivoting contact ceases. Preferably, the access opening is covered by the reclosable flap in the intermediate position.

In such configuration, the rotatable panel and the reclosable flap oppose lid opening over the first few degrees of opening, thereby preventing inadvertent lid opening, especially when the container is in a bag or pocket. Further rotation of the lid towards the open position causes the rotatable panel to come into pivoting contact with the inner package and to pivot about the pivoting edge. As a result, the rotatable panel locally pulls the reclosable flap away from the inner package, thereby reducing the necessary force required to pull apart the reclosable flap from the inner package.

The rotatable panel extends the reclosable flap reach in the open position and tensions the reclosable flap during lid closing, thereby ensuring the precise repositioning of the reclosable flap against the inner package. During lid closing, the pivoting edge of the rotatable panel comes into contact with the inner package at a stop motion position. By applying an additional force, the rotatable panel overcomes the stop motion position and pivots about the pivoting edge to the lid closed position without requiring an additional force. Therefore, a user is reassured that the container is positively closed by this tactile feedback and snapping effect.

The first lid panel may have a length, measured from its rotation axis to an opposite edge, of at least 6 mm, for example of at least 7 mm. This aids attachment of the reclosable flap to the first lid panel, especially when a permanent adhesive is used for that purpose.

The first lid panel may have a length, measured from its rotation axis to an opposite edge, of no more than 12 mm, for example of no more than 10 mm, such as of about 9 mm. By limiting the length of the first lid panel, risk of damaging the panel during lid opening and closing (e.g. by bending) is reduced, thereby broadening material selection options.

In some embodiments the relative movement of the movable panel is rotation. In a preferred embodiment, the first lid panel rotates about an axis parallel to the axis of rotation of the lid. In other embodiments, though, the relative movement of the movable panel is translation, for example, in a direction substantially perpendicular to the inner package. In yet further embodiments, the relative movement of the movable panel is a combination of rotation and translation.

In some embodiments, the first lid panel may be initially fixed relative to the second lid panel. By providing an initial relative fixation of the first and second lid panels, the first lid panel is not relatively movable to the second lid panel during manufacturing and only becomes movable once the one or more breakable connections are ruptured, which occurs when the container is opened for the first time as the reclosable flap is attached to the first lid panel. This eases attachment of the reclosable flap to the first lid panel during manufacturing and prevents possible machine jams.

For example, the first lid panel may be relatively movable to the second lid panel after a breakable connection has been broken. In one particularly preferred example, the first lid panel is connected by one or more breakable connections to a third lid panel.

The one or more breakable or rupturable connections may be formed in different manners. For example, the first and third lid panels may be connected by a line of weakness, which can be continuous or discontinuous. In some examples, the first and third lid panels are connected by a row of perforations. In other examples, the first and third lid panels are connected by a score line with a suitable depth. For example, the depth of the score line can be of about 80% of the thickness of the first and third lid panels, such as of about 90% of the thickness of the first and third lid panels. In yet another example, the first lid panel is partially die cut from the third lid panel, leaving one or more connecting notches.

The container may also include an inner frame, for example a U-shaped inner frame having a front wall and a pair of opposed side walls. In some embodiments the inner frame may be provided inside the inner package surrounding a portion of the consumer goods. In other embodiments, the inner frame is provided between the outer housing and the inner package. By providing an inner frame, the rigidity of the container is increased, which further contributes to increase the reliability of the closing of the access opening.

In a preferred embodiment, in the closed position, the reclosable flap and the inner package are provided next to one another around the periphery of the access opening at a coupling region, the coupling region having a resealable adhesive to releasably affix the inner package and the reclosable flap.

The reclosable flap may be attached to the inner package so as to be movable relative to the inner package about a hinge line. In some embodiments, the reclosable flap may be attached to the outer surface of the inner package so that it covers the access opening in the inner package. In such case, the reclosable flap preferably extends beyond the periphery of the access opening.

In other embodiments, the reclosable flap is defined by a cut line or a line of weakness in the outer surface of the inner package that covers the access opening. In such case, an adhesive label may be adhered to the inner surface of the inner package in a portion where the reclosable flap overlies the adhesive label and the access opening may be provided in the adhesive label, for example, by a cut-out or a line of weakness, or a cut line, that defines a flap that covers the access opening.

The inner package may be formed of metal foil, metallised paper or a plastics film. The inner package material may be formed as a laminate of a metallised plastics film, such as metallised polyethylene film or metallised polypropylene, and a liner material. In addition, the inner package material may be provided with a print-receptive top coating.

The reclosable flap may be formed of, for example, high density polyethylene (HDPE), low density polyethylene (LDPE), biaxially oriented polyproplyene (BOPP), nylon, polystyrene, cellulosic films, such as Cellophane® and cellulose acetate, polyvinylchloride (PVC), paper, polyethylene terephthalate (PET) and mixtures of the foregoing.

Preferably, the consumer goods are smoking articles. However, the container may be suitable for a variety of consumer goods, such as confectionary, dry foodstuff, or the like.

The container is preferably a rectangular parallelepiped comprising two wider walls spaced apart by two narrower walls with right-angled longitudinal and right-angled transverse edges. Alternatively, the container may comprise one or more rounded longitudinal edges, rounded transverse edges, bevelled longitudinal edges or bevelled transverse edges, or combinations thereof.

The container may be formed from any suitable materials including, but not limited to, cardboard, paperboard, plastic, metal, or combinations thereof. Preferably, the outer housing is formed from one or more folded laminar cardboard blanks and, preferably, the cardboard has a weight of between about 230 $g/m^2$ and about 350 $g/m^2$. In some examples, the cardboard has a weight of at least 250 $g/m^2$, for example of about 270 $g/m^2$.

When the container has dimensions similar to those of a conventional smoking article container, the hinge line is located preferably at a distance of the top, back edge of the container of 12 mm or less, such as 10 mm or less, for example of about 8 mm.

Once filled, containers according to the invention may be shrink wrapped or otherwise over wrapped with a transparent polymeric film of, for example, high or low density polyethylene, polypropylene, oriented polypropylene, polyvinylidene chloride, cellulose film, or combinations thereof in a conventional manner. Where containers according to the invention are over wrapped, the over wrapper may include one or more tear tapes. In addition, the over wrapper may be printed with images, consumer information or other data.

As used herein, the terms "front", "back", "upper", "lower", "top", "bottom" and "side" refer to the relative positions of portions of containers according to the invention and components thereof when the container is in an upright position with the lid of the outer housing in the closed position and the hinge line at the back of the container.

The term "longitudinal" refers to a direction from bottom to top or vice versa. The term "transverse" refers to a direction perpendicular to the longitudinal direction.

The term "inner surface" is used throughout the specification to refer to the surface of a component of the assembled container that is facing towards the interior of the container, for example towards the consumer goods, when the container is in the closed position. The term "outer surface" is used throughout the specification to refer to the surface of a component of the container that is facing towards the exterior of the container.

The term "permanent adhesive" is used throughout the present specification to refer to a generally high tack adhesive capable of forming a reliable and secure connection between two substrates such that the two substrates do not become substantially separated during the normal and intended use of the container. In fact, separation of two substrates affixed to one another by means of a permanent adhesive would typically cause some undesirable damage (e.g. tearing) to one or both substrates involved.

The term "resealable adhesive" is used throughout the present specification to describe a generally low tack, removable adhesive capable of forming connection between two substrates such that the two substrates can be repeatedly separated and re-attached to one another.

A second aspect of the invention refers to a blank for forming the outer housing of the container of the first aspect of the invention. The blank has box and lid portions, the lid portion having first, second and third panels. The first panel is hingedly connected to the second panel and is also connected to the third panel by one or more breakable connections. By providing a hinged connection between the first and second panels and one or more breakable connections between the first and third panels, the first panel can be movilised by breaking the one or more connections with the third panel and become rotatable to the second panel. This eases attachment of the reclosable flap to the first lid panel during manufacturing and prevents possible machine jams.

A third aspect of the invention refers to a blank for forming the outer housing of the container of the first aspect of the invention. The blank has box and lid portions, the lid portion having first, second and third panels. The second panel is connected to the first and third panels, the first panel being surrounded by the second and third panels.

According to yet another aspect, the invention also provides a method of forming a container for consumer goods. The method includes the steps of providing an inner package of consumer goods comprising an access opening through which consumer goods can be removed, the access opening being covered by a reclosable flap; providing a blank and folding it about the inner package for forming an outer housing with a hinged lid; and attaching the reclosable flap to a first lid panel of the hinged lid. The step of forming the outer housing from the blank comprises a step of forming the hinged lid in a way such that the first lid panel can move relative to a second lid panel when the container is in use.

In some embodiments, the step of forming the hinged lid comprises not applying permanent adhesive to fix the first lid panel to any other lid panel. By not providing permanent adhesive to fix the first lid panel to any other lid panel, the first lid panel is movable with respect to the second lid panel.

In some embodiments, the step of forming the hinged lid comprises folding the first lid panel against the second lid panel without permanently adhering the first and second lid panels. In other words, the first lid panel may be folded against the second lid panel, but no permanent adhesive may be provided between the first and second lid panels.

According to yet another aspect of the invention there is provided a container for consumer goods, comprising: an outer housing comprising a hinged lid rotatable between open and closed positions; an inner package of consumer goods within the outer housing comprising an access opening through which consumer goods can be removed, the access opening being covered by a reclosable flap; wherein the hinged lid is connected to the reclosable flap so that there is a first opening stage and a second opening stage, and wherein in the first opening stage the hinged lid is operable to lift a first portion of the reclosable flap away from the inner package so that a two-dimensional area of the reclosable flap is separated from a corresponding two-dimensional area of the inner package at substantially the same time, and wherein in the second opening stage the hinged lid is operable to peel a second portion of the reclosable flap away from the inner package.

Preferably the hinged lid comprises a first lid panel and a second lid panel, the first lid panel being relatively movable to the second lid panel. The reclosable flap may be attached to the first lid panel.

In the first opening stage, the reclosable flap may be arranged to pivot away from the inner package together with the first lid panel so that the two-dimensional area of the reclosable flap is separated from the corresponding two-dimensional area of the inner package at substantially the same time.

In the second opening stage, the hinged lid may be arranged to apply a tension to the reclosable flap in order to peel the second portion of the reclosable flap away from the inner package. However, in the first opening stage, substantially no tension may be applied to the reclosable flap.

According to another aspect of the invention there is provided a container for consumer goods, comprising: an outer housing comprising a hinged lid rotatable between open and closed positions; an inner package of consumer goods within the outer housing comprising an access opening through which consumer goods can be removed, the access opening being covered by a reclosable flap; wherein the hinged lid is connected to the reclosable flap so that there is a first closing stage and a second closing stage, and wherein in the first closing stage the hinged lid is operable to roll a second portion of the reclosable flap onto the inner package, and wherein in the second closing stage the hinged lid is operable to lower a first portion of the reclosable flap onto the inner package so that a two-dimensional area of the reclosable flap contacts a corresponding two-dimensional area of the inner package at substantially the same time.

Preferably the hinged lid comprises a first lid panel and a second lid panel, the first lid panel being relatively movable to the second lid panel. The reclosable flap may be attached to the first lid panel.

In the second closing stage, the reclosable flap may be arranged to pivot towards the inner package together with the first lid panel so that the two-dimensional area of the reclosable flap is brought into contact with the corresponding two-dimensional area of the inner package at substantially the same time.

In the first closing stage, the hinged lid may be arranged to apply a tension to the reclosable flap in order to roll the second portion of the reclosable flap over the inner package. However, in the second closing stage, substantially no tension may be applied to the reclosable flap.

According to another aspect of the invention there is provided a method of opening a container for consumer goods, wherein the container comprises an outer housing comprising a hinged lid rotatable between open and closed positions, and an inner package of consumer goods within the outer housing comprising an access opening through which consumer goods can be removed, the access opening being covered by a reclosable flap which is connected to the hinged lid, wherein the method comprises: a first opening stage in which the hinged lid lifts a first portion of the reclosable flap away from the inner package so that a two-dimensional area of the reclosable flap is separated from a corresponding two-dimensional area of the inner package at substantially the same time; and a second opening stage in which the hinged lid peels a second portion of the reclosable flap away from the inner package.

According to yet another aspect of the invention there is provided a method of closing a container for consumer goods, wherein the container comprises an outer housing comprising a hinged lid rotatable between open and closed positions and an inner package of consumer goods within the outer housing comprising an access opening through which consumer goods can be removed, the access opening being covered by a reclosable flap which is connected to the hinged lid, wherein the method comprises: a first closing stage in which the hinged lid rolls a second portion of the reclosable flap onto the inner package; and a second closing stage in which hinged lid lowers a first portion of the reclosable flap onto the inner package so that a two-dimensional area of the reclosable flap contacts a corresponding two-dimensional area of the inner package at substantially the same time.

BRIEF DESCRIPTION OF THE DRAWINGS

The invention will be further described, by way of example only, with reference to the accompanying drawings in which.

DETAILED DESCRIPTION

Figure 1:
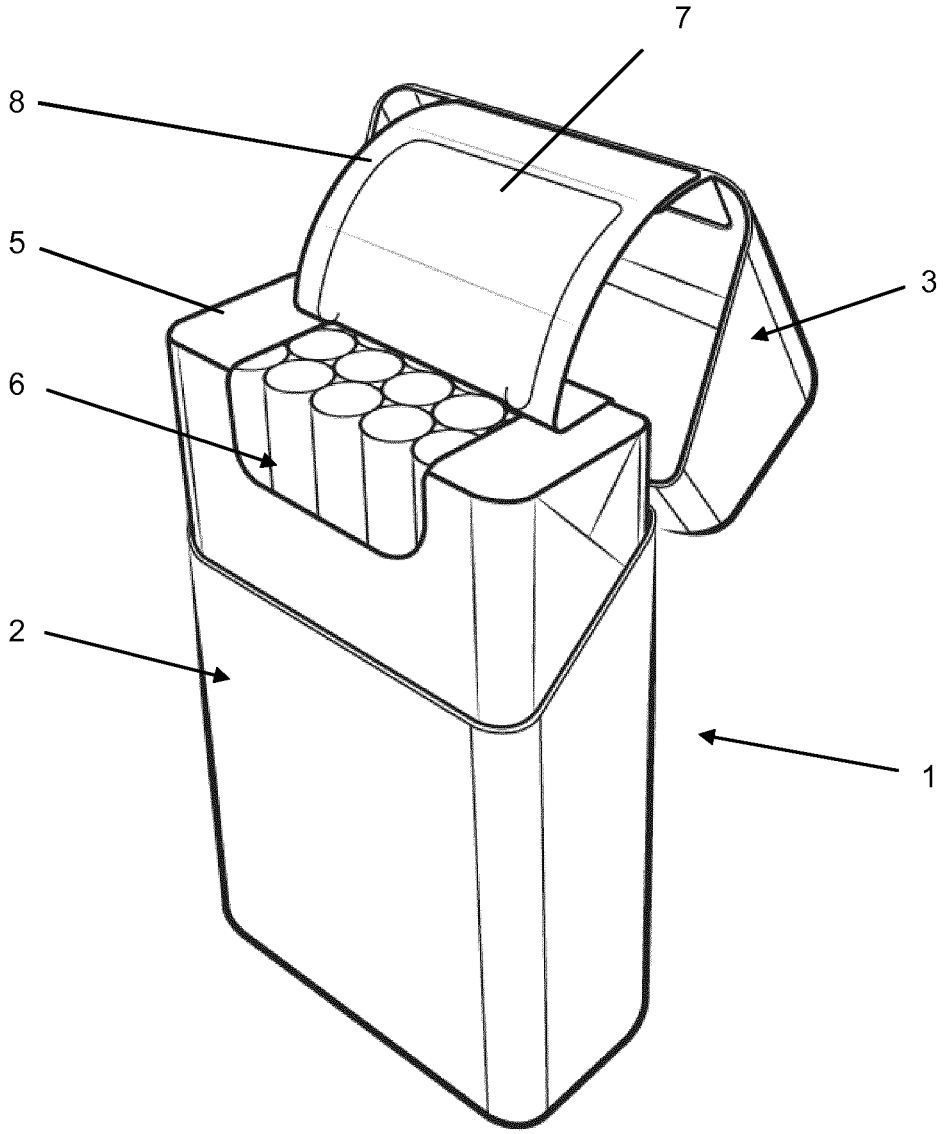
FIG. 1 shows a container of the present invention in a lid open position.

The hinge lid container 1 shown in FIG. 1 comprises a box 2 and a lid 3 that is hinged to the box 2 along a hinge line. FIG. 1 shows the container 1 with the lid 3 in an open position. A bundle of cigarettes, wrapped in an inner package 5, is housed in the box 2 of the container 1.

The box 2 has a box front wall, a box left side wall, a box right side wall, a box back wall, and a box bottom wall. The upper side of the box 2 is open, to provide an upper opening through which the cigarettes can be removed.

The lid 3 has a lid front wall, a lid left side wall, a lid right side wall, a lid back wall and a lid top wall. When the container 1 is closed, the free edges of the walls of the lid 3 abut the free edges of the walls of the box 2 along a line of abutment. In the closed position, the walls of the lid 3 therefore form extensions of the corresponding walls of the box 2 to define the walls of the outer housing 1.

The inner package 5 includes an access opening 6 through which the cigarettes can be removed. When the inner package 5 of cigarettes is in place within the box 2, the access opening 6 is positioned at the open, upper end of the box 2. The access opening 6 includes a cut line that defines a flap 7 that covers the access opening 6. The flap 7 is movable to cover and uncover the access opening 6 and thus negate or allow access to the cigarettes. A line of weakness may be provided instead of the cut line so that the flap 7 separates from the inner package 5 only upon first opening of the container 1. Alternatively, the access opening 6 is a cut-out.

An inner frame 4 (shown in FIG. 9) is mounted within the inner package 5 of the container 1. The inner frame 4 comprises an inner frame front wall, an inner frame left side wall and an inner frame right side wall which are positioned proximate the inner surface of the inner package front wall, inner package left side wall and inner package right side wall, respectively. The inner frame 4 may be optionally connected, for example, glued, to the inner package 5. The inner frame front wall includes a rectangular cut-out at the top free edge, in order to facilitate removal of the cigarettes from the box 2. The rectangular cut-out substantially corresponds to a front wall portion of the access opening 6 in the inner package 5. The walls of the inner frame extend above the upper edges of the box 2.

A reclosable flap 8 is attached to the outer surface of the inner package 5 so that it covers the access opening 6 in the inner package 5. The reclosable flap 8 is affixed to the inner package 5 at the upper, back edge of the inner package 5, which provides a hinge line about which the reclosable flap 8 can be pivoted to open and close the access opening 6. The reclosable flap 8 extends beyond the periphery of the access opening and is also affixed to the inner package flap 7.

The reclosable flap 8 in this embodiment is a self-adhesive label. The label 8 includes a resealable adhesive on its inner surface, which overlies a portion of the inner package 5 substantially around the periphery of the access opening 6. When the lid 3 is in the closed position the resealable adhesive affixes the adhesive label 8 to the inner package 5.

The resealable adhesive may also be used to affix the inner package flap 7, although it is preferred to use a permanent adhesive to prevent the inner package flap 7 from peeling off the label 8 after a number of openings. The resealable adhesive may be a pressure sensitive adhesive. The permanent adhesive may be a UV-cured pressure sensitive adhesive.

Figure 2:
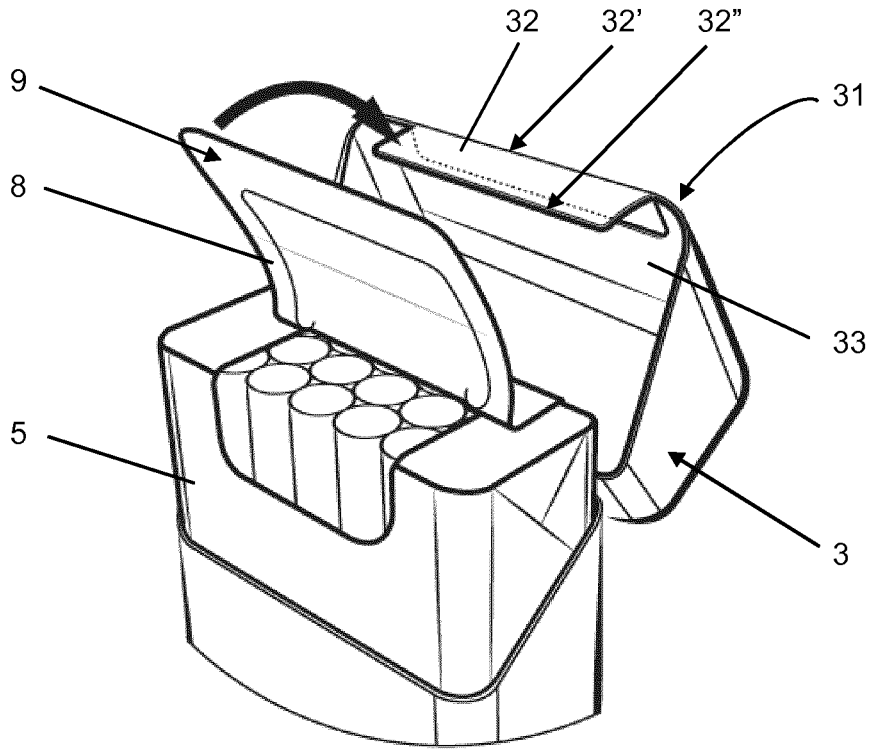
FIG. 2 shows a detail of the container of FIG. 1.

As shown in FIG. 2, the lid front wall comprises a lid outer front panel 31 and two lid inner front panels 32, 33 connected to the lid outer front panel 31 by a crease line. A first lid inner front panel 32 is connected to the lid outer front panel 31 only by the crease line, which defines a rotation axis 32' about which the first lid inner front panel 32 may rotate relative to the lid outer front panel 31. The first lid inner front panel 32 is, thus, rotatable about the lower front edge of the lid 3 relative to the lid outer front panel 31. A second lid inner front panel 33 is connected to the lid outer front panel 31 by the crease line and by permanent adhesive so that the lid outer front panel 31 and the second lid inner front panel 33 do not move relatively.

The outer surface of the label 8 is permanently affixed at its free end 9 to the first lid inner front panel 32, for example with a permanent adhesive, such as a hot melt adhesive. As a result, movement of the lid 3 causes movement of the label 8 and of the first lid inner front panel 32, which rotates relatively to the lid outer front panel 31. The inner surface of the free end 9 of the label 8 may be substantially free of resealable adhesive to reduce the force required to open the lid 3. Alternatively, the resealable adhesive applied to the inner surface of the label 8 may extend to its free end 9 to firmly close the lid 3.

In order to access the cigarettes within the inner package 5, the hinge lid 3 is moved from the closed position to the open position shown in FIG. 1. As the lid 3 is moved from the closed position, an edge 32" of the first lid inner front wall 32 is brought into pivotal contact with the outer surface of the inner package 5. This causes the first lid inner front wall 32 to pivot about the edge 32" from an initial position in which the first lid inner front wall 32 is substantially parallel to the lid outer front wall 31 to a position in which the first lid inner front wall 32 is approximately perpendicular to the lid outer front wall 31, as can be appreciated in FIG. 3. Further rotation of the hinge lid 3 peels off the label 8 from the inner package 5, thereby uncovering the access opening 6 in the inner package 5 through which one or more cigarettes can be removed.

Therefore, the container 1 of the present invention provides a two-stage opening of the lid 3. In a first stage, the free end 9 of the reclosable flap or label 8 is pivoted about the inner package 5. In a second stage, the reclosable flap or label 8 is peeled off the inner package 5, thereby uncovering the access opening 6 in the inner package 5. In the first stage the reclosable flap or label 8 preferably does not even partially uncover the access opening 6.

In order to close the container 1, the hinge lid 3 is moved from the open position to the closed position. As the lid 3 is moved from the open position, the label 8 is rolled over the inner package 5, thereby covering the access opening 6 in the inner package 5. The first lid inner front panel 32 extends the label 8 reach in the open position and tensions the label 8 during lid closing, thereby ensuring the precise repositioning of the adhesive label 8 against the inner package 5. The edge 32" of the first lid inner front wall 32 comes into contact with the inner package 5 at a stop motion position shown in FIG. 3. Further rotation of the hinge lid 3 causes the first lid inner front wall 32 to pivot about the edge 32" from an initial position in which the first lid inner front wall 32 is approximately perpendicular to the lid outer front wall 31 to a position in which the first lid inner front wall 32 is substantially parallel to the lid outer front wall 31, thereby closing the container 1.

Therefore, the container 1 of the present invention provides a two-stage closing of the lid 3. In a first stage, the reclosable flap or label 8 is rolled over the inner package 5, thereby covering the access opening 6 in the inner package 5. In a second stage, the free end 9 of the reclosable flap or label 8 is pivoted about the inner package 5.

Figure 3:
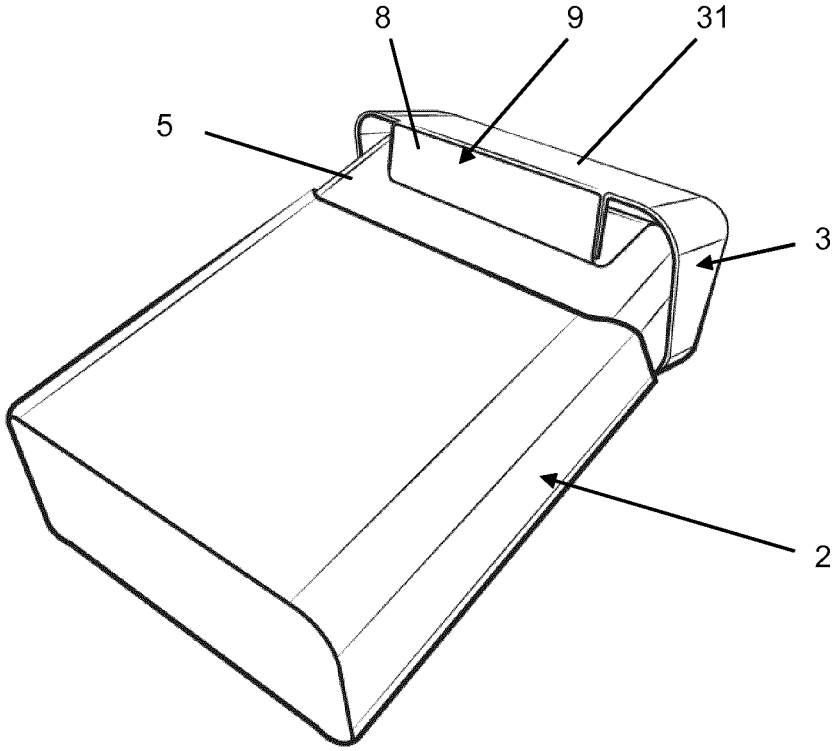
FIG. 3 shows the container of FIG. 1 with the lid in an intermediate position.

The lid 3 is therefore movable about the box 2 between open and closed positions through an intermediate, stable position shown in FIG. 3. Movement of the lid 3 between the closed position and the intermediate position, or vice versa, requires overcoming a biasing force, which may be generated by cooperation of the reclosable flap 8 and a movable lid panel, the first lid inner front panel 32 in this embodiment.

Figure 4:
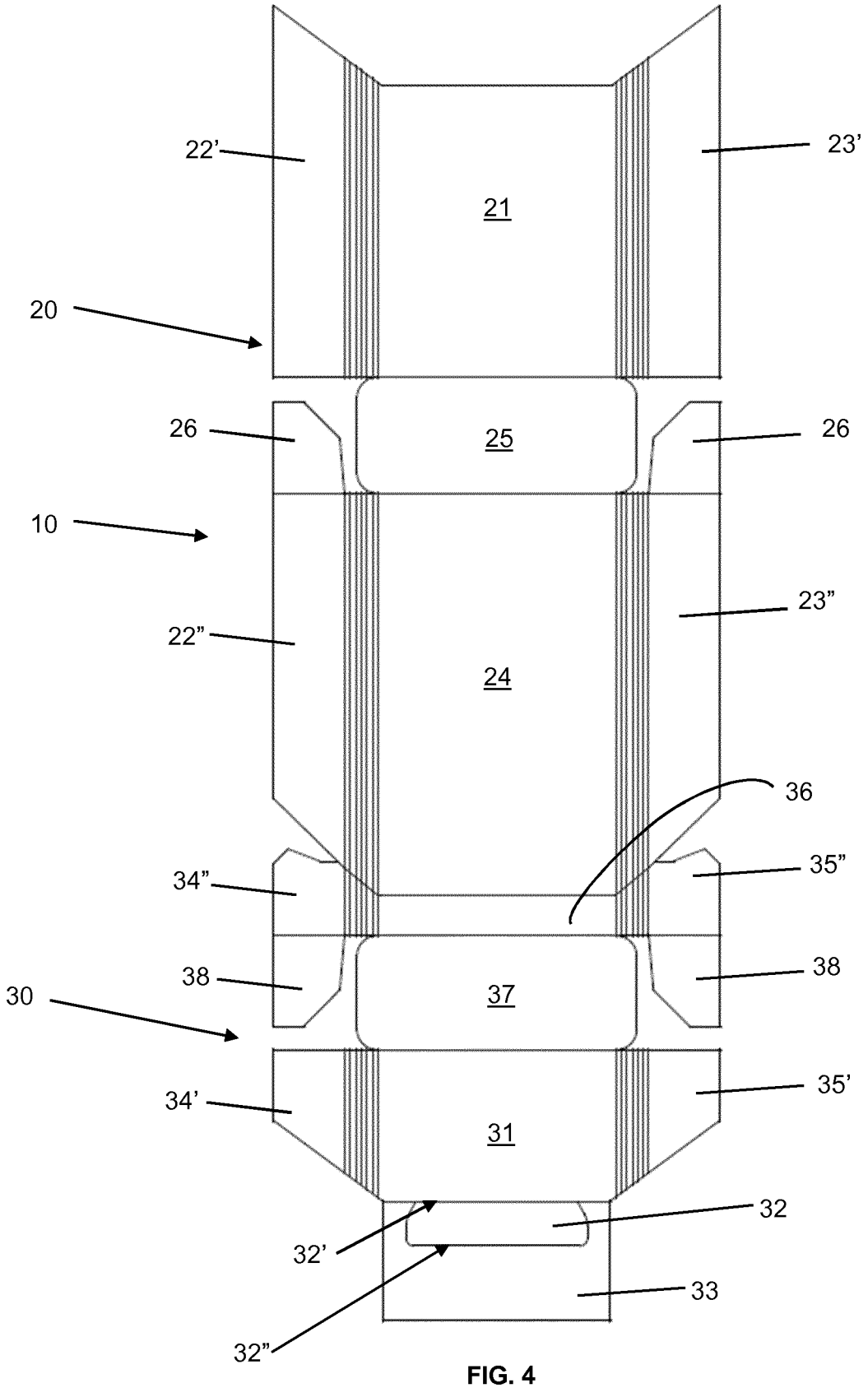
FIG. 4 shows a first embodiment of a blank for forming an outer housing of the present invention.

FIG. 4 shows a blank 10 for forming the outer housing 1 represented in FIGS. 1 to 3. The blank 10 is divided into two blank portions, a box portion 20 and a lid portion 30. Each blank portion comprises a plurality of panels in which each individual panel is connected to at least another panel, for example, by a crease or fold line.

The box portion 20 comprises a box front panel 21, box outer and inner left side panels 22', 22", box outer and inner right side panels 23', 23", a box back panel 24, a box bottom panel 25 and two box gluing flaps 26. Although in FIG. 4 the connections of the box front panel 21 and the box back panel 24 to the box outer and inner left and right side panels 23', 23", 24', 24" are shown as a plurality of parallel longitudinal crease lines, these connections could equally be made by single longitudinal crease lines. The remaining panel connections are single transverse crease lines.

In order to assemble the box 2 of the outer housing 1, the box gluing flaps 26 are glued to the box bottom panel 25 to form the box bottom wall. To form the box left side wall, the box inner left side panel 22" is glued to the box outer left side panel 22'. The box inner right side panel 23" is glued to the box outer right side panel 23' to form the box right wall.

The lid portion 30 comprises a lid outer front panel 31, two lid inner front panels 32, 33, lid outer and inner left side panels 34', 34", lid outer and inner right side panels 35', 35", a lid back panel 36, a lid top panel 37 and two lid gluing flaps 38. The lid back panel 36 is hingedly connected (e.g. by a crease line) to box back panel 24.

Although in FIG. 4 the connections of the lid outer front panel 31 and the lid back panel 36 to the lid outer and inner left and right side panels 34', 34", 35', 35" are shown as a plurality of parallel longitudinal crease lines, these connections could equally be made by single longitudinal crease lines. The remaining panel connections are single transverse crease lines.

In this embodiment, both the first and second lid inner front panels 32, 33 are connected to the lid outer front panel 31 as the first lid inner front panel 32 is surrounded by the second lid inner front panel 33. Although not shown in FIG. 4, the first and second lid inner front panels 32, 33 may be connected by one or more breakable connections. These one or more breakable connections may be provided along at least one of the edges of the first lid inner front panel 32 that are not connected to the lid outer front panel 31, preferably, at least along an edge 32", which is opposite the edge 32' of the first lid inner front panel 32 that is connected to the lid outer front panel 31.

To form the lid 3, both lid inner front panels are folded 180° with respect to the lid outer front panel 31 so that they contact, but only the lid outer front panel 31 and the second lid inner front panel 33 are glued together. The lid gluing flaps 38 are glued to the lid top panel 37 to form the lid top wall. The lid left side wall is formed by gluing the lid inner left side panel 34" to the lid outer side panel 34'. Finally, the lid inner right side panel 35" is glued to the lid outer right side panel 35'.

Preferably, an adhesive-free region is defined around the periphery of the first lid inner front panel 32 to prevent adhesive trickling into the first lid inner front panel 32. The average width of the adhesive-free region may be of at least 1 mm, for example of about 2 mm.

Figure 5:
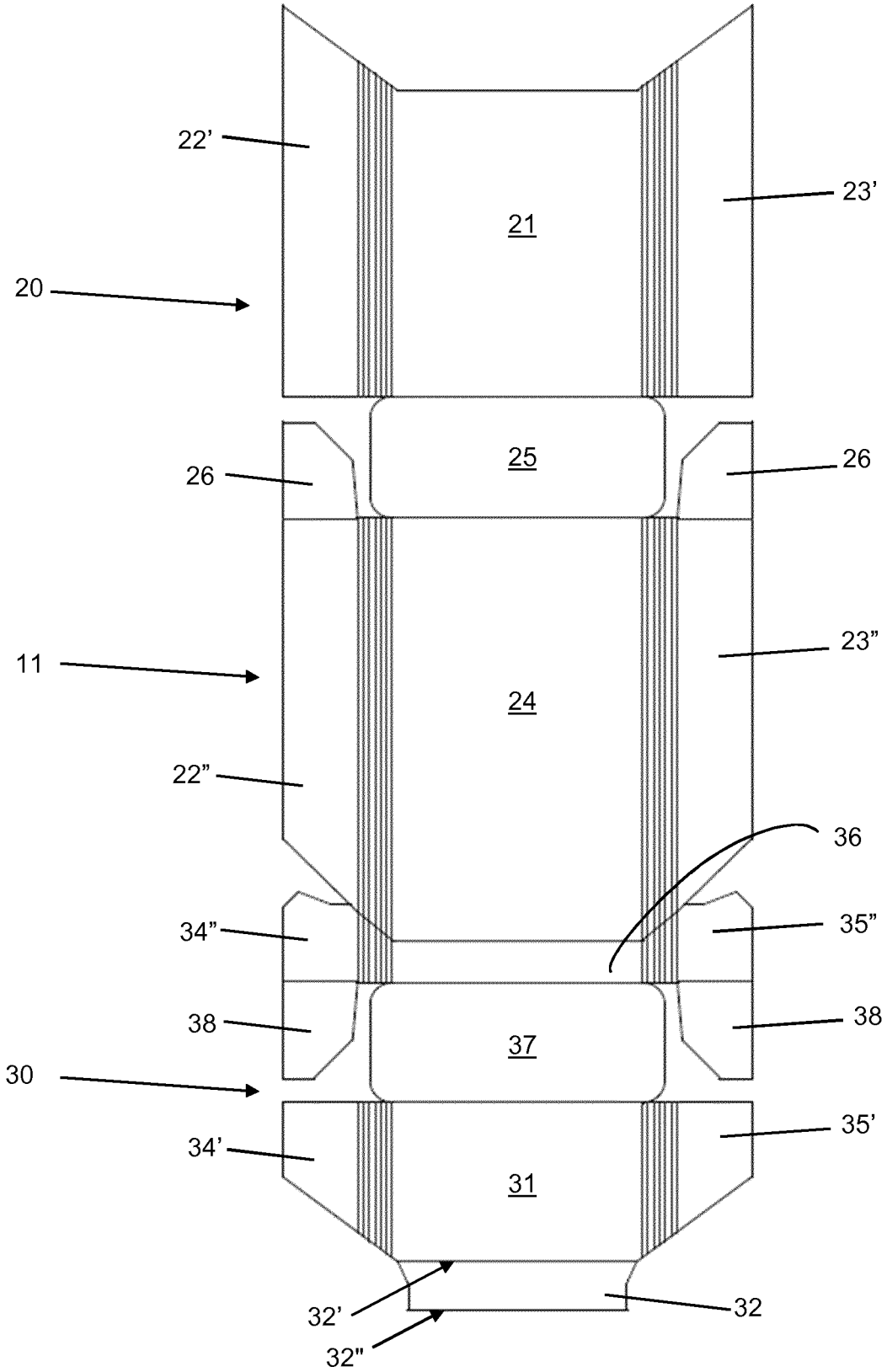
FIGS. 5 and 6 show, respectively, second and third embodiments of a blank for forming an outer housing of the present invention.
Figure 6:
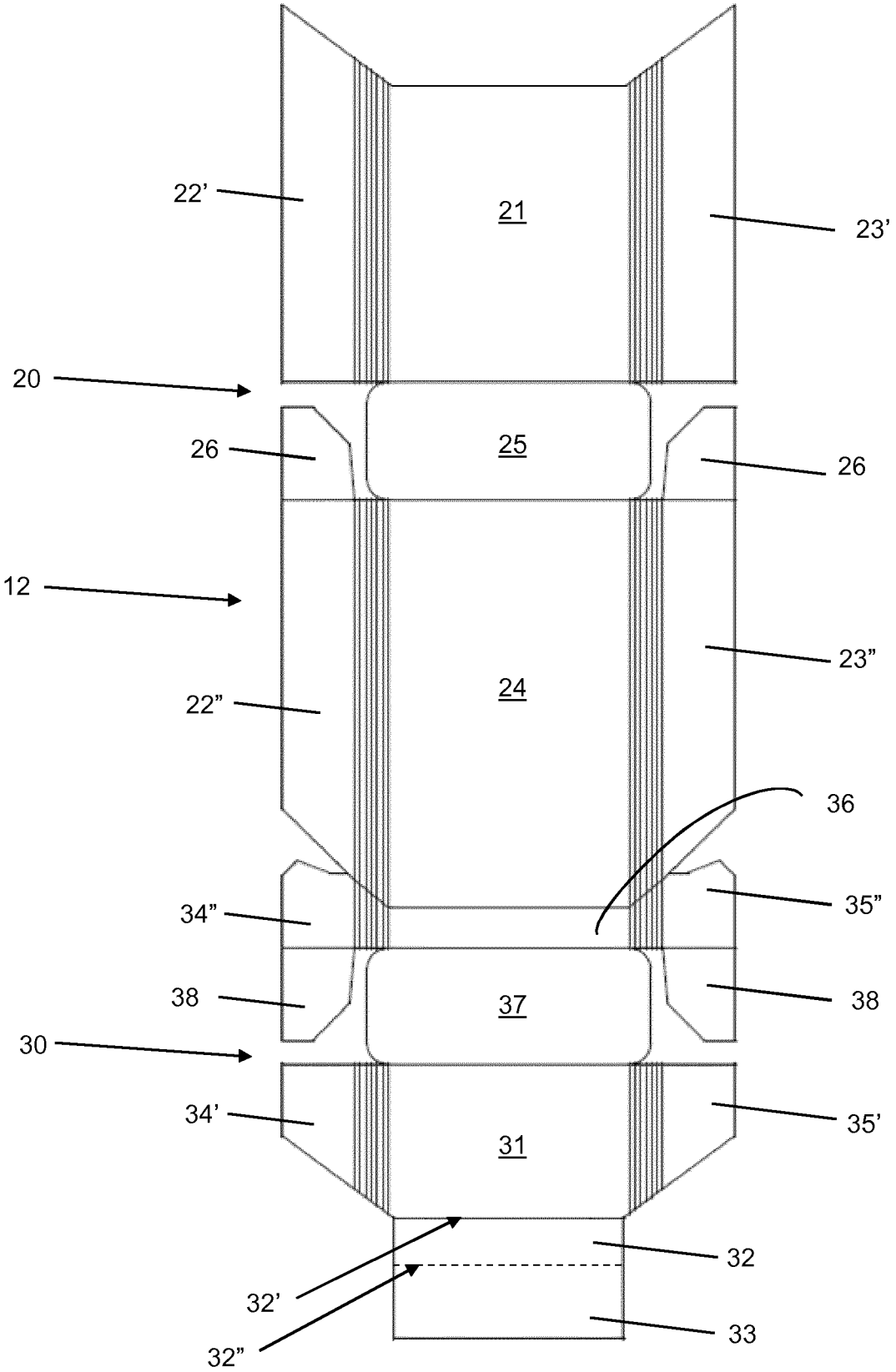

FIGS. 5 and 6 show alternative blanks 11, 12 for forming an outer housing 1 similar to the one represented in FIGS. 1 to 3. For the sake of brevity, only differences between the blanks will be explained below and the same numbering used for the blank 10 of the first embodiment will be used to refer to similar elements.

The blank 11 of the second embodiment shown in FIG. 5 differs from the blank 10 of the first embodiment in that the lid portion 30 has only one lid inner front panel 32. When the lid 3 is formed, the lid inner front panel 32 is folded 180° with respect to the lid outer front panel 31 so that they contact, but no glue is applied to adhere those two panels.

The blank 12 of the third embodiment shown in FIG. 6 differs from the blank 10 of the first embodiment in that the first lid inner front panel 32 is connected at one edge 32' to the lid outer front panel 30 by a crease or fold line and to the second lid inner front panel 33 at another, opposite edge 32" by a line of weakness, such as a row of perforations. The line of weakness 32" may be formed during a step of forming the outer housing 1, preferably before any panels of the blank 12 are folded, for example with a rotary scoring tool.

When the lid 3 is formed, the first lid inner front panel 32 is folded 180° with respect to the lid outer front panel 31 so as to contact. As the second lid inner front panel 33 is connected to the first lid inner front panel 32, by folding the first lid inner front panel 32 with respect to the lid outer front panel 31, the second lid inner front panel 33 and the lid outer front panel 31 also contact. These latter panels are adhered together.

Preferably, an adhesive-free region is defined around the periphery of the first lid inner front panel 32 to prevent adhesive trickling into the first lid inner front panel 32. The average width of the adhesive-free region may be of at least 1 mm, for example of about 2 mm.

When the reclosable flap 8 is affixed to the first lid inner front panel 32 and the container 1 is opened for the first time, the opening force breaks the line of weakness 32" that connects the first and second lid inner front panels 32, 33, thereby movilising the first lid inner front panel 32, which becomes rotatable about the crease line 32' that connects it to the lid outer front panel 31. The second lid inner front panel 33 remains attached to the lid outer front panel 31.

Figure 7A:
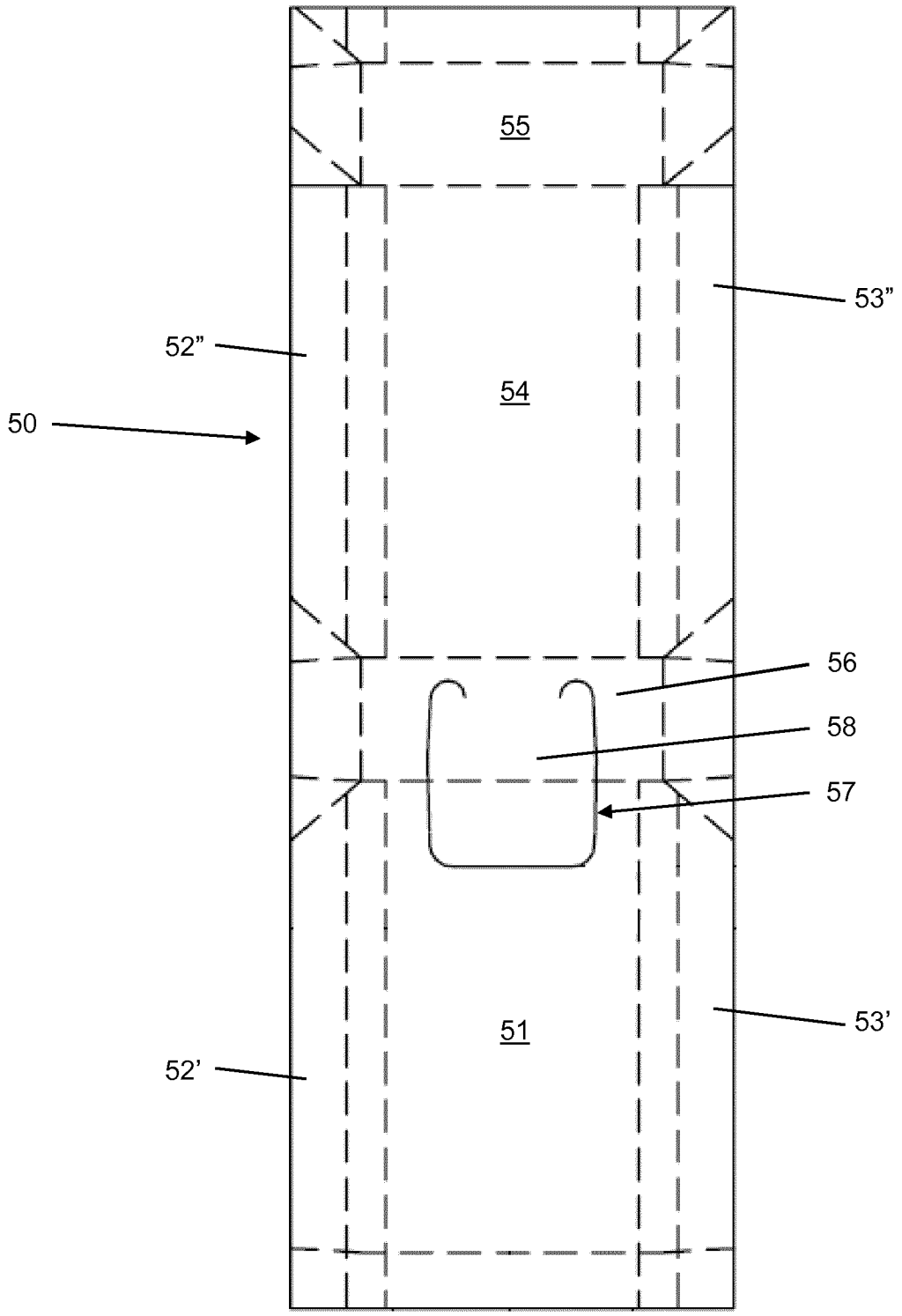
FIGS. 7A and 7B show two different embodiments of a blank for forming an inner package of the present invention.
Figure 7B:
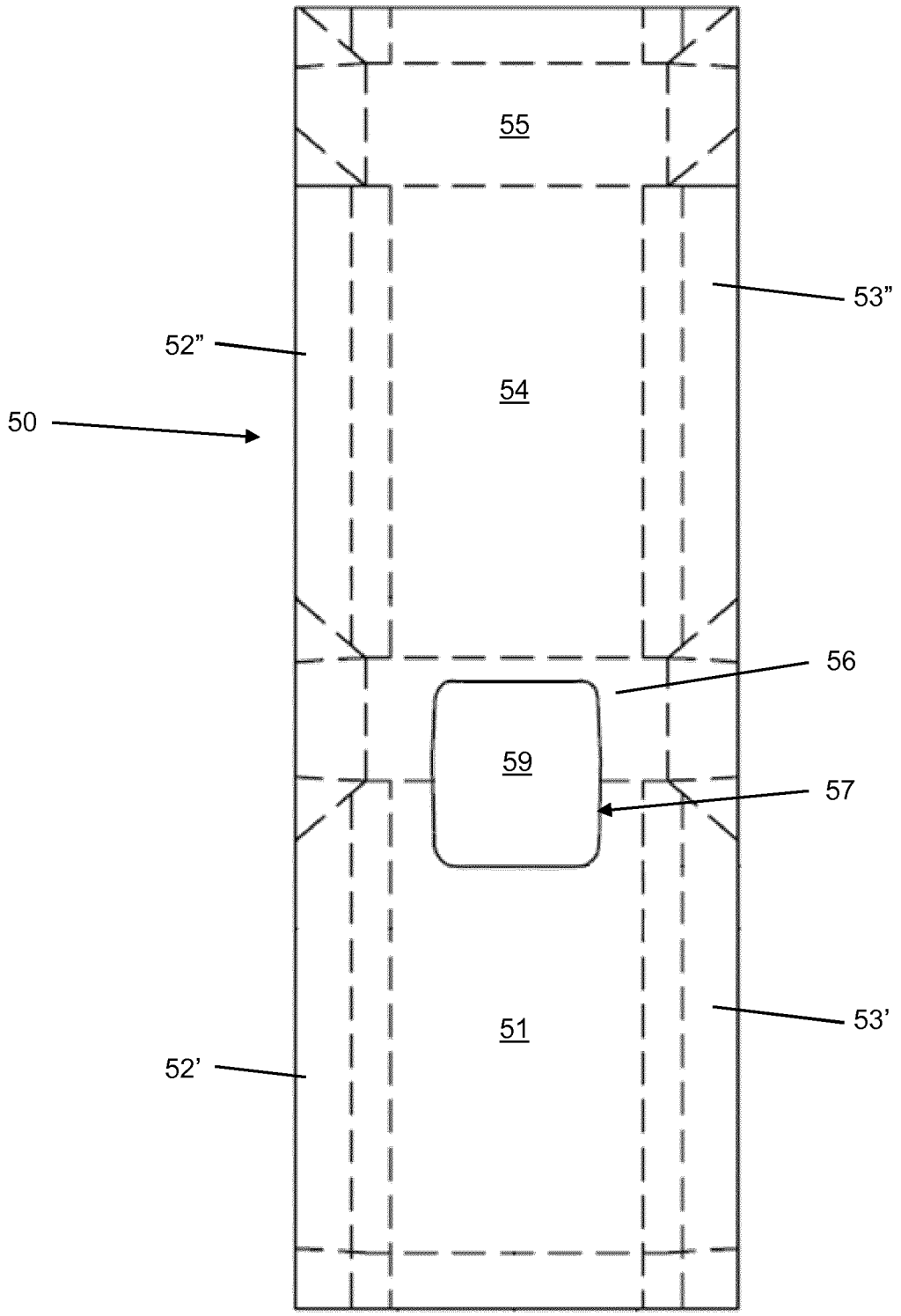

FIGS. 7A and 7B show two alternative blanks for forming the inner package 5 represented in FIGS. 1 to 3. The inner package blanks 50 are made from a substantially rectangular sheet of wrapping material that is folded along the longitudinal and transverse dashed lines represented in FIGS. 7A and 7B.

The inner package blank 50 comprises an inner package front panel 51, inner package outer and inner left side panels 52', 52", inner package outer and inner right side panels 53', 53", an inner package back panel 54, an inner package bottom panel 55 and an inner package top panel 56. Although in FIGS. 7A and 7B the separation of the inner package front panel 51 and the inner package back panel 54 from the inner package outer and inner left and right side panels 53', 53", 54', 54" is shown each as two parallel longitudinal fold lines, this separation could equally be made by a single longitudinal fold line.

The inner package blank 50 represented in FIG. 7A includes a cut line 57 that defines a flap 58. A line of weakness may be provided instead of the cut line so that the flap 7 separates from the inner package 5 only upon first opening of the container 1.

To form an inner package 5 from any of the blanks 50 represented in FIGS. 7A and 7B, the inner package outer and inner left side panels 52', 52" are connected (e.g. by glue application or heat-sealing) to each other to form the inner package outer left wall. The inner package right wall is formed by connecting the inner package outer and inner right side panels 53', 53".

In the inner package blank 50 represented in FIG. 7B, the cut line 57 defines a cut-out 59.

Figure 8:
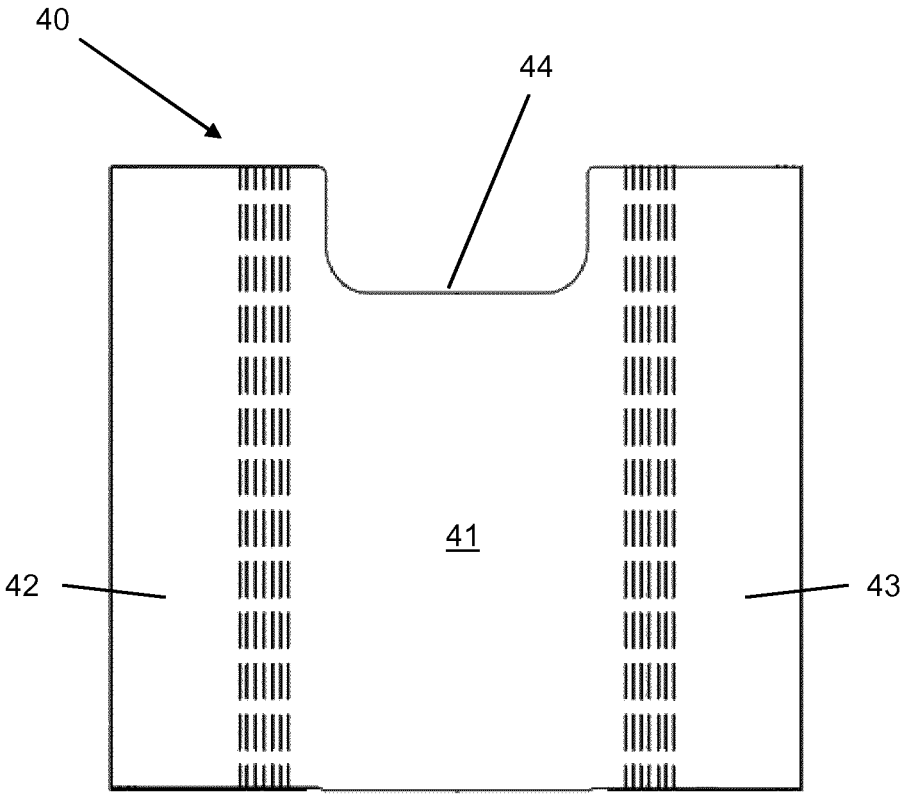
FIG. 8 shows an embodiment of a blank for forming an inner frame of the present invention.

FIG. 8 shows a blank 40 for forming the inner frame housed in the inner package 5 of FIGS. 1 to 3. The inner frame blank 40 comprises an inner frame front panel 41, an inner frame left side panel 42 and an inner frame right side panel 43. Although in FIG. 8 the connections of the inner frame front panel 41 to the inner frame left and right side panels 42, 43 are shown as a plurality of parallel longitudinal crease lines, these connections could equally be made by single longitudinal crease lines.

The inner frame front panel 41 includes a rectangular cut-out 44 at the top free edge, in order to facilitate removal of the cigarettes from the box 2 when the inner frame is assembled from the blank 40. The rectangular cut-out 44 substantially corresponds to a front wall portion of the access opening 6 in the inner package 5.

To form the inner frame, the inner frame left and right side panels 42, 43 are folded approximately 90° with respect to the inner frame front panel 41. In the assembled condition, the inner frame front panel 41 corresponds to the inner frame front wall, and the inner frame left and right side panels 42, 43 correspond, respectively, to the inner frame left and right side walls.

Figure 9:
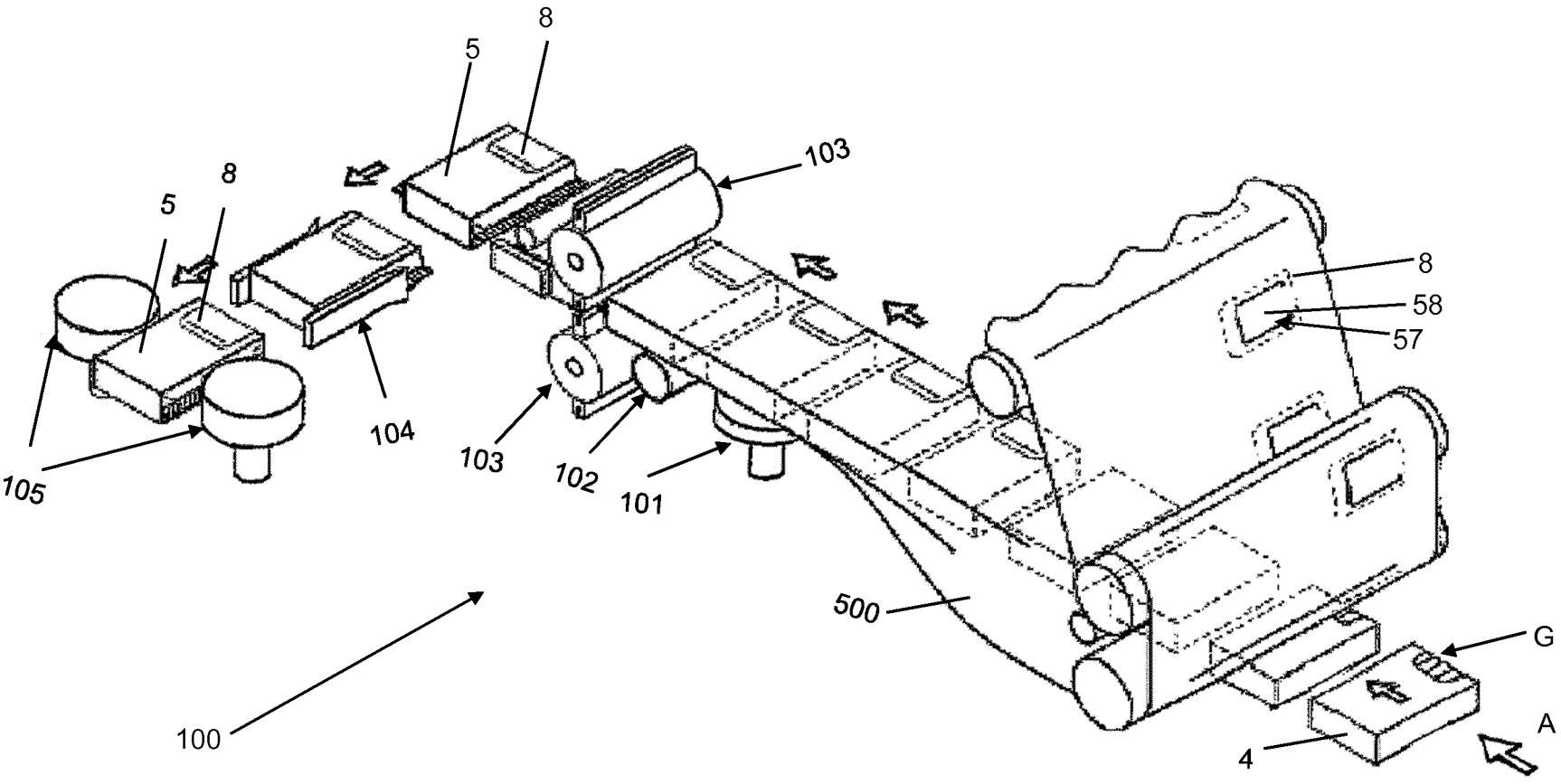
FIG. 9 shows a system for forming an inner package of the present invention.

FIG. 9 shows a system or apparatus 100 for forming an inner package 5 housing smoking articles, such as cigarettes or the like, according to one embodiment of this invention. A series of inner frames 4, each of which is respectively combined with a charge of cigarettes, is transported in direction of arrow A along a packaging path by apparatus 100. The framed charged cigarettes G are conveyed under a continuous sheet of wrapping material 500 (e.g. a metallised plastics laminate film) which is fed from a supply roll (not shown). The wrapping sheet 500 has pre-formed reclosable flaps 8 for alignment with the respective access apertures 44 in the inner frame front panel 41 of each inner frame 4 transported under the wrapping sheet 500.

Rollers 101 arranged below the serially progressing inner frames 4 draw the wrapping sheet 500 tautly over the front and back faces of the framed charge of cigarettes G and against opposite ends of the framed charge of cigarettes G, thereby wrapping the same to form inner package front, top, back and bottom walls. The rollers 101 then cooperate with a sealing head 102 to fuse or seal the drawn wrapping sheet 500 to form a transverse seam at the inner package back wall (not shown). A further elongate sealing head 103 (or pair thereof) following the rollers 101 then operate(s) to clamp and fuse a lateral seam (e.g. as a "fin seal") in the barrier sheet 500 between each of the framed charge of cigarettes G to form the inner package left and right side walls. Trimmers 104 and rollers 105 may then trim and flatten the seams 13, 14 to complete the individual inner packages 5.

A set of blanks for forming the outer housing 1 according to any of the embodiments represented in FIGS. 4 to 6 are folded and glued about the inner package 5 to form the box 2 and lid 3, as previously explained. A permanent adhesive is applied at the outer surface of the reclosable flap 8, particularly at its free edge 9, to connect the reclosable flap 8 to the first lid inner front panel 32. As a result, a container for consumer goods according to the invention is formed.

The invention claimed is:

1. A container for consumer goods, comprising:

an outer housing comprising a hinged lid rotatable between open and closed positions;

an inner package of consumer goods within the outer housing comprising an access opening through which consumer goods can be removed, the access opening being covered by a reclosable flap;

wherein the hinged lid is connected to the reclosable flap so that there is a first opening stage and a second opening stage, and wherein in the first opening stage the hinged lid is operable to lift a first portion of the reclosable flap away from the inner package so that a two-dimensional area of the reclosable flap is separated from a corresponding two-dimensional area of the inner package at substantially the same time, and wherein in the second opening stage the hinged lid is operable to peel a second portion of the reclosable flap away from the inner package, wherein the hinged lid comprises a first lid panel, a second lid panel, and an outer lid panel, the first lid panel being relatively movable to the second lid panel, a first end of the first lid panel being pivotably connected to a first end of the outer lid panel, the second lid panel being adhered to the outer lid panel, a first end of the second lid panel connected to one of the first end or a second end of the first lid panel, and wherein the reclosable flap is attached to the first lid panel.

2. The container of claim 1, wherein, in the first opening stage, the reclosable flap is arranged to pivot away from the inner package together with the first lid panel so that the two-dimensional area of the reclosable flap is separated from the corresponding two-dimensional area of the inner package at substantially the same time.

3. The container of claim 1, wherein, in the second opening stage, the hinged lid is arranged to apply a tension to the reclosable flap in order to peel the second portion of the reclosable flap away from the inner package.

4. The container of claim 1, wherein, in the first opening stage, substantially no tension is applied to the reclosable flap.

5. The container of claim 1, further comprising an inner frame within the outer housing.

6. The container of claim 1, wherein the second end of the first lid panel is configured to pivotally contact the inner package or an inner frame disposed within the outer housing during movement of the lid between the open and closed positions.

7. The container of claim 6, wherein the edge of the first lid panel is opposite a rotation axis of the first lid panel.

8. The container of claim 1, wherein the second lid panel is breakably connected to the first lid panel.

9. A container for consumer goods, comprising:

an outer housing comprising a hinged lid rotatable between open and closed positions;

an inner package of consumer goods within the outer housing comprising an access opening through which consumer goods can be removed, the access opening being covered by a reclosable flap;

wherein the hinged lid is connected to the reclosable flap so that there is a first closing stage and a second closing stage, and wherein in the first closing stage the hinged lid is operable to roll a second portion of the reclosable flap onto the inner package, and wherein in the second closing stage the hinged lid is operable to lower a first portion of the reclosable flap onto the inner package so that a two-dimensional area of the reclosable flap contacts a corresponding two-dimensional area of the inner package at substantially the same time, wherein the hinged lid comprises a first lid panel, a second lid panel, and an outer lid panel, the first lid panel being relatively movable to the second lid panel, a first end of the first lid panel being pivotably connected to a first end of the outer lid panel, the second lid panel being adhered to the outer lid panel, a first end of the second lid panel connected to one of the first end or a second end of the first lid panel, and wherein the reclosable flap is attached to the first lid panel.

10. The container of claim 9, wherein, in the second closing stage, the reclosable flap is arranged to pivot towards the inner package together with the first lid panel so that the two-dimensional area of the reclosable flap is brought into contact with the corresponding two-dimensional area of the inner package at substantially the same time.

11. The container of claim 9, wherein, in the first closing stage, the hinged lid is arranged to apply a tension to the reclosable flap in order to roll the second portion of the reclosable flap over the inner package.

12. The container of claim 9, wherein, in the second closing stage, substantially no tension is applied to the reclosable flap.

13. The container of claim 9, further comprising an inner frame within the outer housing.

14. The container of claim 9, wherein the second end of the first lid panel is configured to pivotally contact the inner package or an inner frame disposed within the outer housing during movement of the lid between the open and closed positions.

15. The container of claim 14, wherein the edge of the first lid panel is opposite a rotation axis of the first lid panel.

16. The container of claim 9, wherein the second lid panel is breakably connected to the first lid panel.

* * * * *